US009157613B2

(12) United States Patent
Tsai et al.

(10) Patent No.: US 9,157,613 B2
(45) Date of Patent: Oct. 13, 2015

(54) MOBILE ELECTRONIC DEVICE

(71) Applicant: Wistron NeWeb Corp., Hsinchu (TW)

(72) Inventors: Yung-Ping Tsai, Hsinchu (TW); Yung-Lin Wu, Hsinchu (TW); Yun-Yi Ting, Hsinchu (TW); Heng-Ching Feng, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 170 days.

(21) Appl. No.: 14/029,213

(22) Filed: Sep. 17, 2013

(65) Prior Publication Data

US 2014/0218911 A1 Aug. 7, 2014

(30) Foreign Application Priority Data

Feb. 1, 2013 (TW) ..... 102103889 A

(51) Int. Cl.

| | |
|---|---|
| ***F21V 21/00*** | (2006.01) |
| ***F21V 11/18*** | (2006.01) |
| ***G04G 17/04*** | (2006.01) |

(52) U.S. Cl.

CPC ..... *F21V 21/00* (2013.01); *F21V 11/18* (2013.01); *G04G 17/04* (2013.01)

(58) Field of Classification Search

USPC ..... 362/249.02, 249.04, 249.06, 277, 280, 362/282, 283, 284, 321, 322, 324, 109, 362, 362/367, 257

See application file for complete search history.

(56) References Cited

U.S. PATENT DOCUMENTS

| | | | | |
|---|---|---|---|---|
| 2010/0033972 | A1* | 2/2010 | Maglica et al. | 362/294 |
| 2011/0058387 | A1* | 3/2011 | Matsunaga et al. | 362/547 |
| 2012/0218748 | A1* | 8/2012 | Conrad | 362/230 |
| 2013/0201696 | A1* | 8/2013 | Hisayasu et al. | 362/363 |

FOREIGN PATENT DOCUMENTS

| | | |
|---|---|---|
| TW | M283693 | 12/2005 |
| TW | M284348 | 1/2006 |

* cited by examiner

*Primary Examiner* — Laura Tso

(74) *Attorney, Agent, or Firm* — Muncy, Geissler, Olds & Lowe, P.C.

(57) ABSTRACT

A mobile electronic device is provided, including a first housing, a second housing and a circuit board assembly. The first housing is connected to the second housing to form a receiving space with the circuit board assembly disposed therein. The circuit board assembly includes a first circuit board having a plurality of light emitting diodes, a second circuit board, and a frame disposed between the first circuit board and the second circuit board.

12 Claims, 6 Drawing Sheets

MOBILE ELECTRONIC DEVICE

CROSS REFERENCE TO RELATED APPLICATIONS

The present application claims priority of Taiwan Patent Application No. 102103889, filed on Feb. 1, 2013, the entirety of which is incorporated by reference herein.

BACKGROUND OF THE INVENTION

1. Field of the Invention

The present application relates to a mobile electronic device, and in particular, relates to a mobile electronic device having a frame with circuit boards disposed thereon.

2. Description of the Related Art

Mobile electronic devices usually have features of portability and miniaturization. However, with progress in the functions of mobile electronic devices, the available space therein for receiving electrical elements must be increased, which conflicts with the trend for compact dimensions.

BRIEF SUMMARY OF THE INVENTION

In view of the aforesaid problem, an embodiment of the invention provides a mobile electronic device including a first housing, a second housing and a circuit board assembly. The first housing is connected to the second housing to form a receiving space with the circuit board assembly disposed therein. The circuit board assembly includes a first circuit board with a plurality of light emitting diodes, a second circuit board, and a frame disposed between the first circuit board and the second circuit board.

The invention can minimize the size of the mobile electronic device by using a frame which increases the space for receiving circuit boards, as well as electrical elements. Moreover, the frame can be directly engaged with the first housing of the mobile electronic device, thus eliminating tolerances during assembly of the first housing (with some elements, such as click buttons and openings), the second housing and the circuit board assembly, and simplifying assembly processes.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1A:
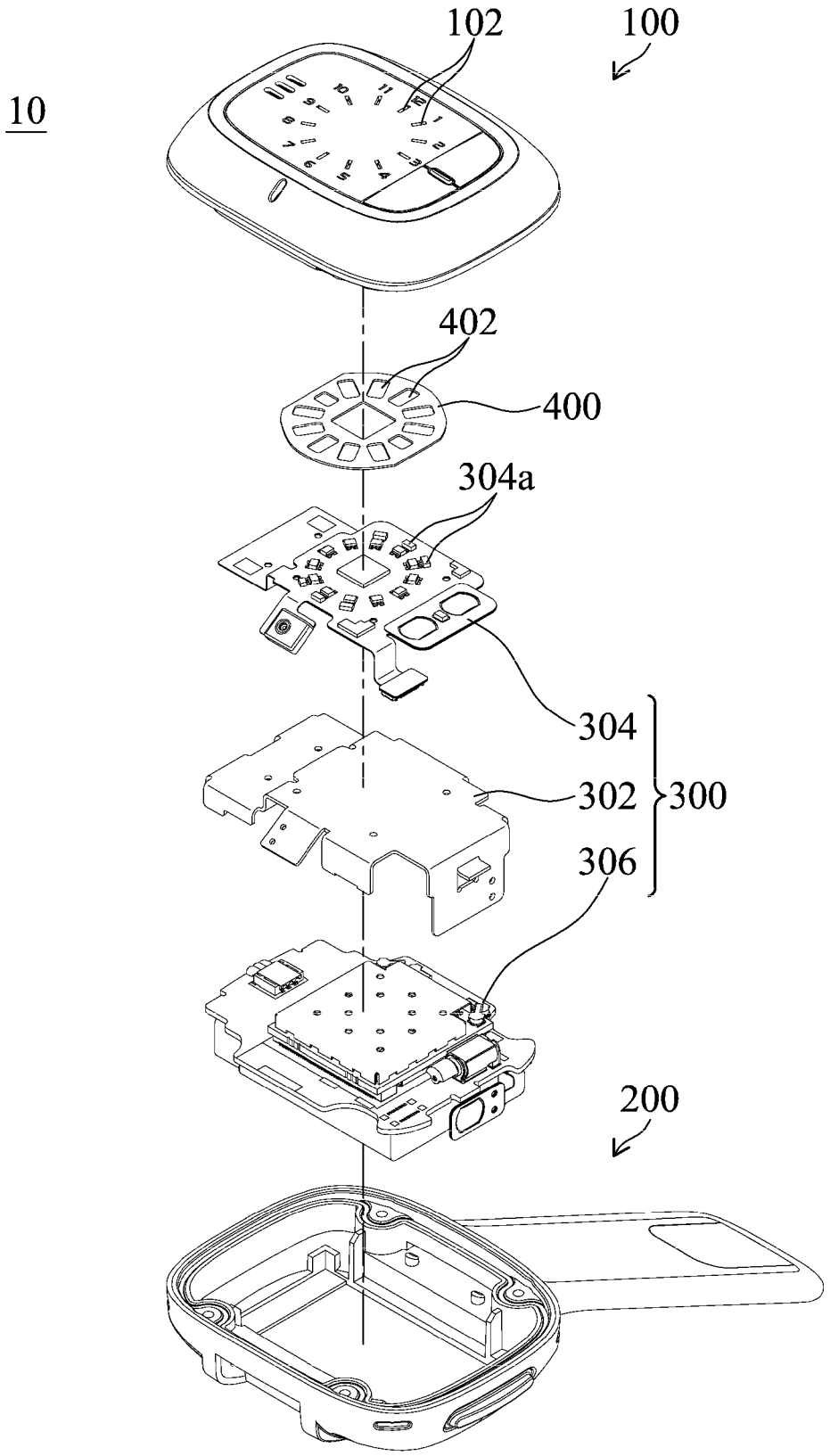
FIG. 1A is an exploded diagram of a mobile electronic device according to an embodiment of the invention.
Figure 1B:
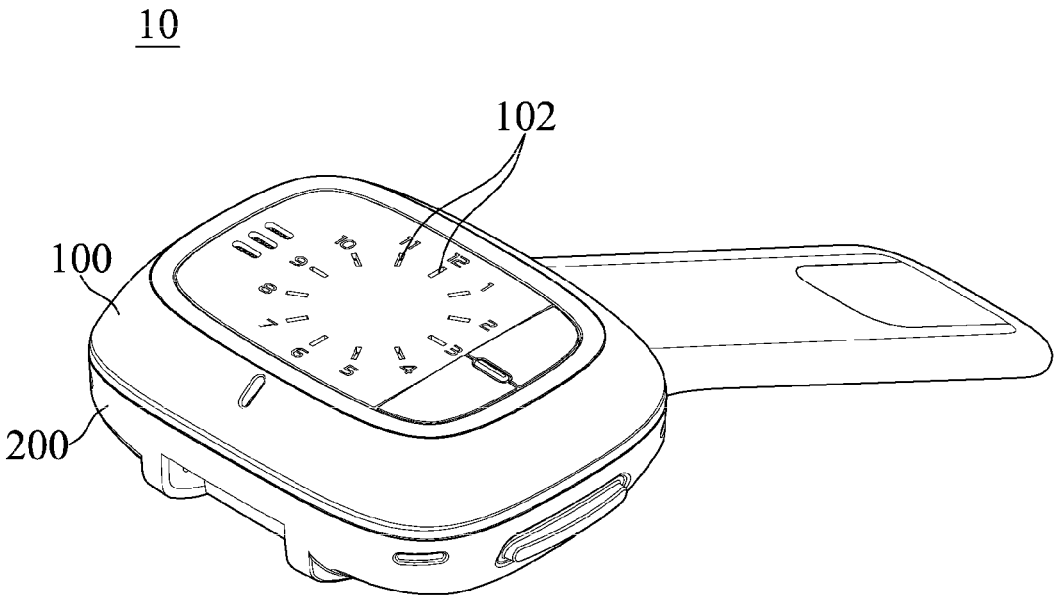
FIG. 1B is a perspective diagram of the magnetic element of FIG. 1A after being assembled.

Referring to FIGS. 1A and 1B, an embodiment of a mobile electronic device 10 primarily includes a first housing 100, a second housing 200, and a circuit board assembly 300. During assembly, the first housing 100 and the second housing

200 are joined with each other (FIG. 1B) and form a space receiving the circuit board assembly 300. The circuit board assembly 300 includes a frame 302, a first circuit board 304, and a second circuit board 306, wherein the frame 302 is disposed between the first and second circuit boards 304 and 306. The first circuit board 304 and the first housing 100 are disposed on the upper side of the frame 302, and the second circuit board 306 and the second housing 200 are disposed on the lower side of the frame 302.

Note that, the mobile electronic device 10 may be used to provide Mobile Personal Emergency Response Services (MPERSs). At least one click button or speaker hole is disposed on a surface of the first housing 100 (FIG. 1A) for communicating and requesting for help from a medical unit or family member of a user when the user has an emergency.

The mobile electronic device 10 may have a function for showing the time. Referring to FIGS. 1A and 1B, the first housing 100 includes twelve openings 102 arranged in circle, wherein the numbers 1 to 12 are respectively marked on a surface of the first housing 100 corresponding to the openings 102. Additionally, twelve light emitting diodes (LEDs) 304*a* are mounted on the first circuit board 304 and correspondingly arranged in a circle. In some embodiments, each of the plurality of LEDs 304*a* can emit two colored lights, so that the different colored lights from the plurality of LEDs 304*a* through the openings 102 can indicate the time at five-minute intervals. For example, if a green light passes the opening 102 corresponding to the number 12 marked on the first housing 100, and a red light passes the opening 102 corresponding to the number 2 marked on the first housing 100, the time now can be read as twelve ten.

In this embodiment, the mobile electronic device 10 further includes a shutter 400 disposed between the first housing 100 and the first circuit board 304 (FIG. 1A). The shutter 400 may comprise elastic material, such as rubber, foam, or mylar etc., which is opaque. The shutter 400 includes twelve openings 402 arranged in a circle, wherein the positions and dimensions of the openings 402 respectively correspond to the plurality of LEDs 304*a* on the first circuit board 304. Thus, the shutter 400 can isolate the plurality of LEDs 304*a* from each other, so as to prevent light interference from the plurality of LEDs 304. The shutter 400 can also prevent light leakage from undesired gaps of the first housing 100.

Owing to assembly tolerances of the mobile electronic device 10, some noise may occur during usage. Hence, the shutter 400 having elastic material can not only absorb assembly tolerances but also efficiently suppress noise.

Figure 2A:
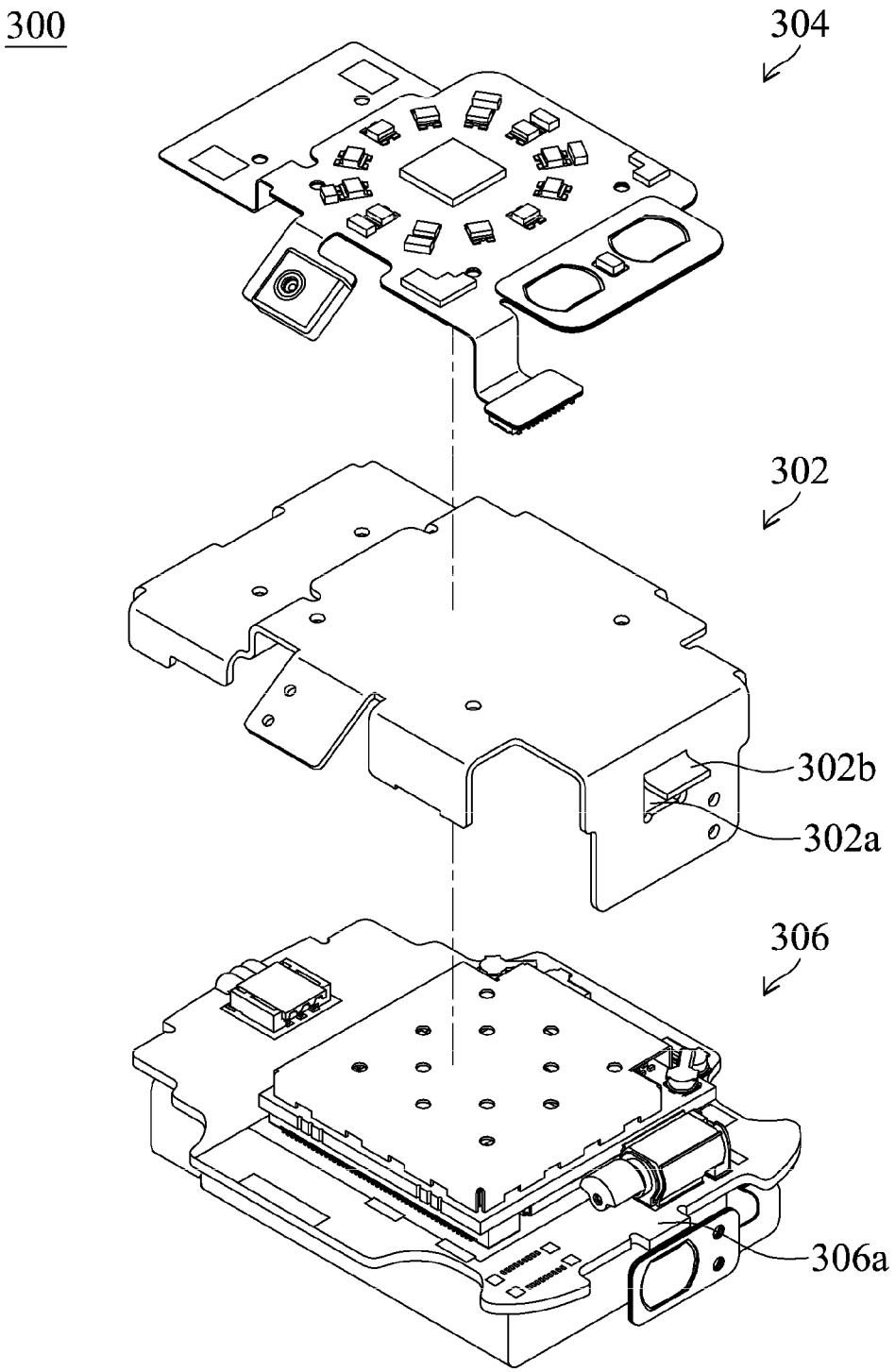
FIG. 2A is an exploded diagram of a circuit board assembly according to an embodiment of the invention.
Figure 2B:
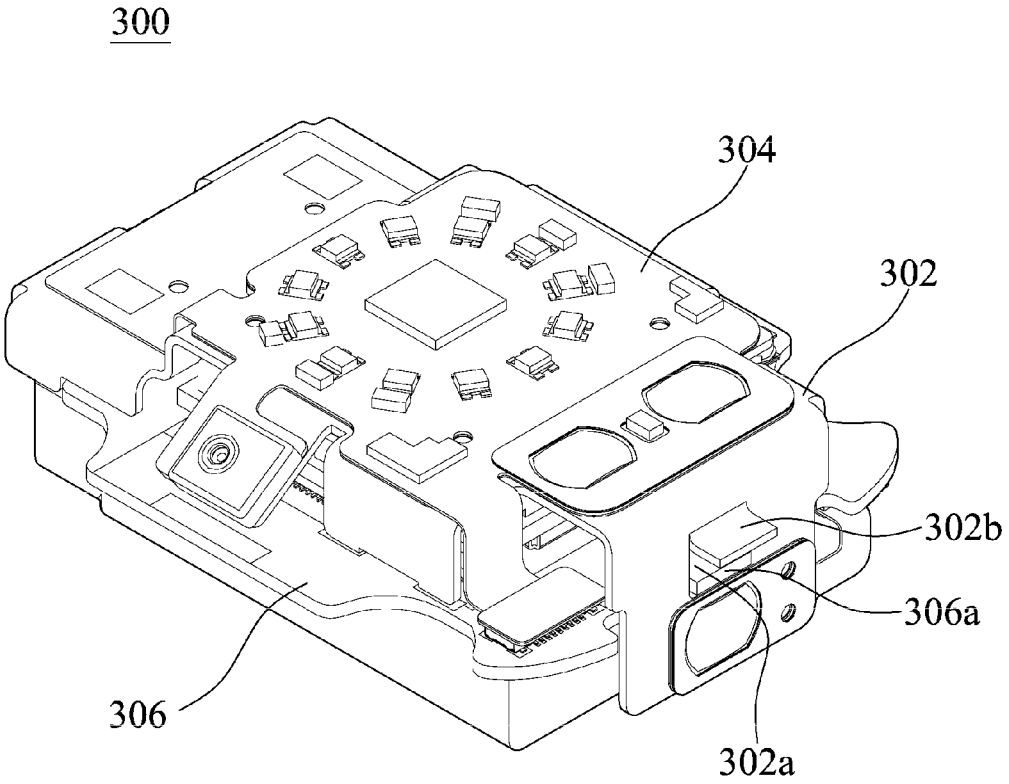
FIG. 2B is a perspective diagram of the circuit board assembly of FIG. 2A after being assembled.

Referring to FIGS. 2A and 2B, the first and second circuit boards 304 and 306 are respectively disposed on the upper and lower sides of the frame 302 of the circuit board assembly 300, thus increasing space for receiving electrical elements within the mobile electronic device 10. In this embodiment, the frame 302 comprises metal and can be formed by a metal punching process, so as to facilitate the manufacturing process and miniaturization of the electronic device. Additionally, since the metal frame 302 is integrally formed in one piece, the strength of the circuit board assemble 300 can be enhanced against pressure loading from the first housing 100, and a haptic feedback and contact feeling when pressing the click button can also be improved.

In some embodiments, the frame 302 may comprise other materials, such as plastic having a certain structural strength.

As shown in FIGS. 2A and 2B, the first circuit board 304 in this embodiment is adhered to the upper side of the frame 302, and the second circuit board 306 is engaged with the frame 302 and disposed on the lower side thereof. The frame 302 has a first recess 302*a*, and the second circuit board 306 has a first protrusion 306*a* engaged with the first recess 302*a*.

Figure 3A:
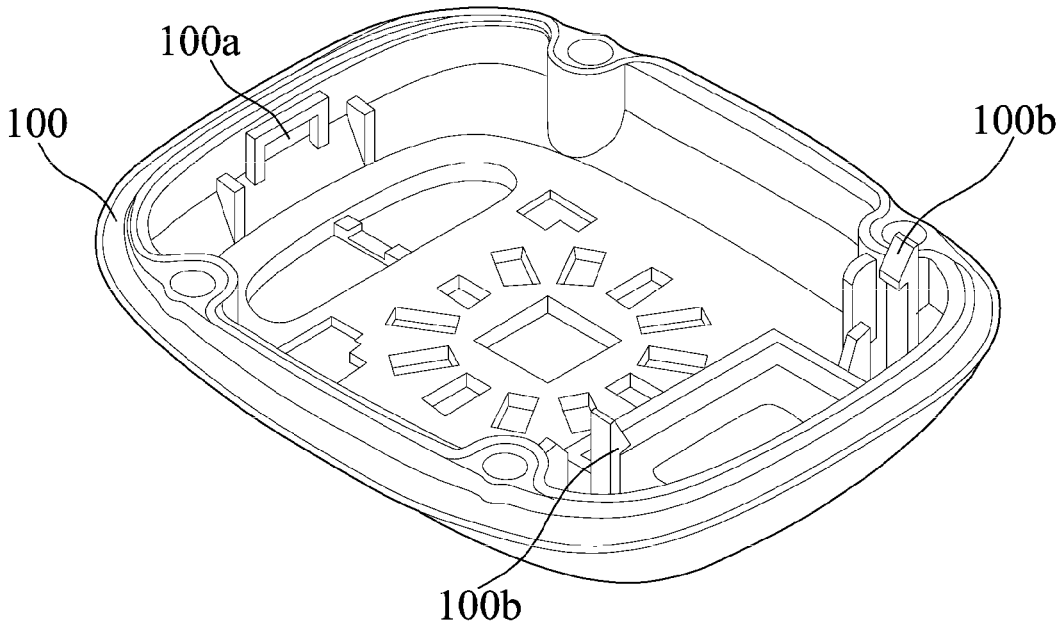
FIG. 3A is a perspective diagram of a first housing according to an embodiment of the invention.
Figure 3B:
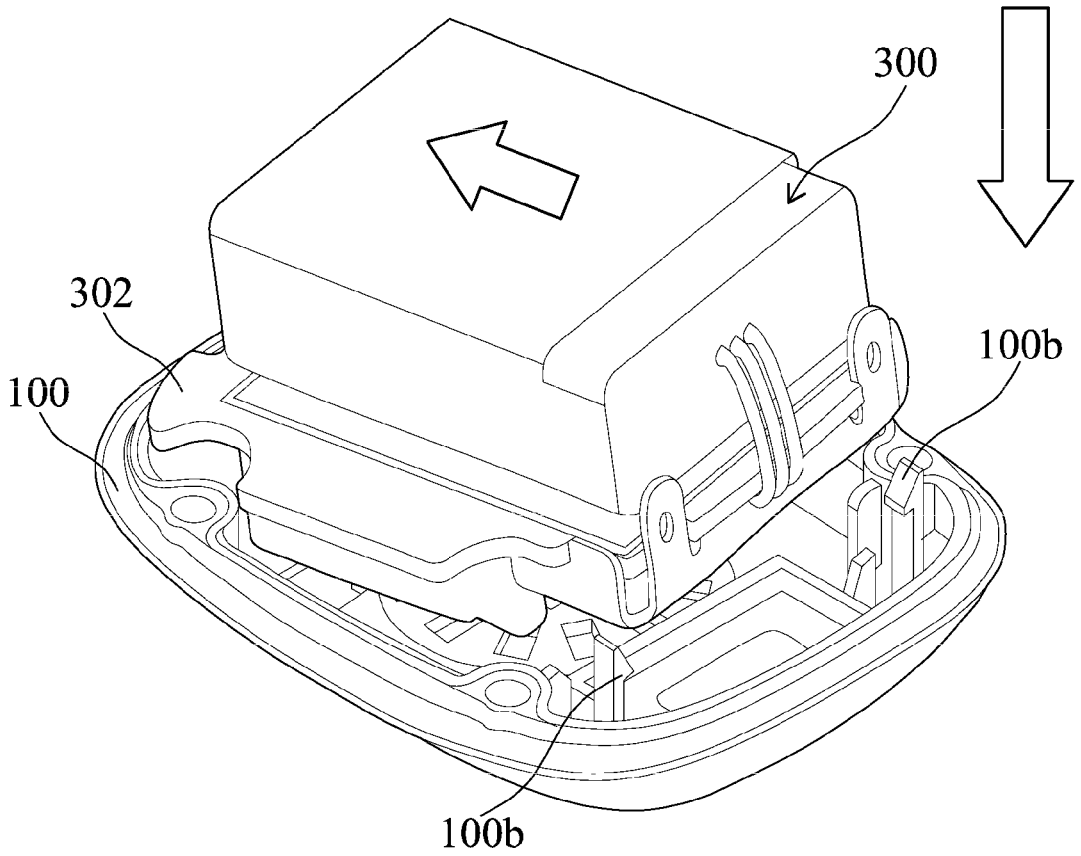
FIG. 3B is a perspective diagram of the first housing of FIG. 3A engaged with a circuit board assembly.

FIG. 3A is a perspective diagram of the first housing 100. FIG. 3B is a perspective diagram of the first housing 100 engaged with the circuit board assembly 300. Note that, the circuit board assembly 300 is engaged with the first housing 100, and then the first and second housings 100 and 200 are joined to each other to accomplish the assembly of the mobile electronic device 10.

Referring to FIGS. 2B, 3A and 3B, the frame 302 of the circuit board assembly 300 has a second protrusion 302*b*, and the first housing 100 has a second recess 100*a* and at least one latch 100*b* (as the latches 100*b* shown in FIG. 3A). The second protrusion 302*b* can be engaged with the second recess 100*a*, as the leftward arrow shows in FIG. 3B. Subsequently, the circuit board assembly 300 is pressed toward the first housing 100 (as the downward arrow shows in FIG. 3B), so that the circuit board assembly 300 is fastened by the two latches 100*b* of the first housing 100 to firmly connect the first housing 100 with the circuit board assembly 300.

Note that, the circuit board assembly 300 in this embodiment is directly engaged with the first housing 100, thus simplifying the assembly processes, reducing production costs, and eliminating the assembly tolerances between the click button of the first housing 100 and the circuit board assembly 300, compared with the condition that the circuit board assembly 300 is connected with the second housing 200. Moreover, the stability when pressing the click button can also be improved.

The invention provides a mobile electronic device having a frame. The frame has double-layer spaces for receiving circuit boards, thus increasing space for receiving the electrical elements within the mobile electronic device and facilitating miniaturization thereof. The frame can be directly engaged with the first housing, so that the assembly tolerances of the electronic device can be reduced. In addition, the mobile electronic device may further include a shutter disposed between the first housing and the first circuit board, thus preventing the colored lights of the plurality of LEDs from interfering with each other when in a narrow space.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile electronic device, comprising:

a first housing;

a second housing, connected to the first housing to form a receiving space therebetween; and a circuit board assembly, disposed in the receiving space, comprising a first circuit board having a plurality of light emitting diodes (LEDs), a second circuit board, and a frame disposed between the first circuit board and the second circuit board, wherein the frame has a substantially flat structure with a first side and a second side opposite to each other, and the first and second circuit boards are respectively disposed on the first and second sides.

2. The mobile electronic device as claimed in claim 1, wherein the mobile electronic device further comprises a shutter disposed between the first housing and the first circuit board, wherein the shutter includes a plurality of openings corresponding to the plurality of LEDs.

3. The mobile electronic device as claimed in claim 2, wherein the dimensions of the openings correspond to that of the plurality of LEDs.

4. The mobile electronic device as claimed in claim 1, wherein the frame is engaged with the second circuit board.

5. The mobile electronic device as claimed in claim 4, wherein the frame has a first recess, and the second circuit board has a first protrusion engaged with the first recess.

6. The mobile electronic device as claimed in claim 1, wherein the frame is engaged with the first housing.

7. The mobile electronic device as claimed in claim 6, wherein the frame has a second protrusion, and the first housing has a second recess and at least one latch, wherein the second protrusion is engaged with the second recess, and the circuit board assembly is fastened to the first housing by the latch.

8. The mobile electronic device as claimed in claim 1, wherein the frame comprises metal.

9. The mobile electronic device as claimed in claim 2, wherein the shutter comprises an opaque elastic material.

10. The mobile electronic device as claimed in claim 1, wherein the plurality of LEDs are mounted on the first circuit board and arranged in a circle.

11. A mobile electronic device capable of showing time, comprising:

a first housing, including twelve light transmission openings;

a second housing, connected to the first housing to form a receiving space therebetween; and a circuit board assembly, disposed in the receiving space, comprising a first circuit board having twelve light emitting diodes (LEDs), a second circuit board, and a frame disposed between the first circuit board and the second circuit board, wherein the positions of the light transmission openings of the first housing correspond to the LEDs, so that the lights from the LEDS through different light transmission openings can show the time.

12. The mobile electronic device as claimed in claim 11, wherein the frame has a substantially flat structure with a first side and a second side opposite to each other, and the first and second circuit boards are respectively disposed on the first and second sides.

* * * * *